United States Patent [19]

Uriarte

[11] Patent Number: 4,681,131

[45] Date of Patent: Jul. 21, 1987

[54] LIQUID CLOSING DEVICE

[76] Inventor: José I. Uriarte, 20 General Alava, Vitoria, Spain

[21] Appl. No.: 824,283

[22] Filed: Jan. 30, 1986

[30] Foreign Application Priority Data

Feb. 1, 1985 [EP] European Pat. Off. ..... 85200127.0

[51] Int. Cl.[4] ..... E03C 1/28

[52] U.S. Cl. ..... 137/247.35; 137/247.15; 137/247.43

[58] Field of Search ..... 137/247.11, 247.13, 137/247.15, 247.35, 247.43

[56] References Cited

U.S. PATENT DOCUMENTS 2,199,675 5/1940 Ronning ..... 137/247.15 X 4,524,795 6/1985 Ericson et al. ..... 137/247.11 X

*Primary Examiner*—Gerald A. Michalsky

*Attorney, Agent, or Firm*—John P. Snyder

[57] ABSTRACT

A device for closing a transport duct for a liquid with the aid of said liquid, for example, a siphon, said device mainly comprising a housing (1) with a liquid chamber, a tube stub (4) connected in airtight manner with said housing (1) and reaching at the most up to the liquid chamber and a drain stub (5) opening out above the liquid chamber for connection with the transport duct (15), wherein around the pipe stub (4) there is arranged a body (8) capable of floating on the liquid, while airtight means (10) are arranged between the floating body (8) and either the pipe stub (4) or the wall of the housing (1), whereby it is no longer necessary to have the pipe stub (4) reaching into the liquid in the liquid chamber so that, when liquid is drained, a stream can directly flow beyond the liquid chamber towards the transport duct (15).

19 Claims, 3 Drawing Figures

LIQUID CLOSING DEVICE

Figure 1:
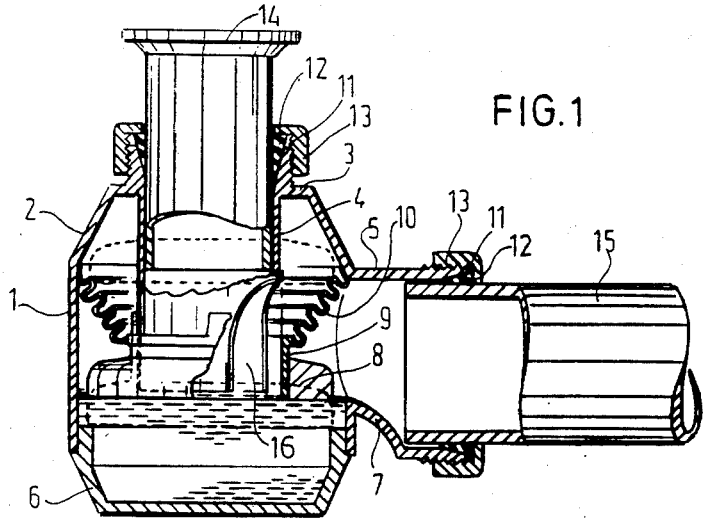

The invention relates to a device for closing a transport duct for a liquid with the aid of said liquid, for example, a siphon said device mainly comprising a housing with a liquid chamber, a tube stub connected in airtight manner with said housing and reaching at the most up to the liquid chamber and a drain stub opening out above the liquid chamber for connection with the transport duct.

Devices of the kind set forth in the preamable are used for closing ducts of, for example, sanitary systems so that gases produced in the drain pipe (sewer) cannot get out. The device should operate in a manner such that in the case of excess pressure in the transport duct the closing effect remains safe. In the event of subatmospheric pressure in the transport duct it has to be ensured that the liquid chamber should not be emptied by suction. In order to fulfill the latter requirement in an effective manner closing devices are known which comprise a valve mechanism, in which owing to the subatmospheric pressure in the transport duct air is sucked in from the outside, said devices having, however, the disadvantage that the valve does not always effectively close so that an open communication with the transport duct and the open air may be formed.

Other known devices use a large amount of liquid as a trap, which impedes a quick draining of the liquid to the transport duct across the device.

The invention has for its object to obviate the above mentioned disadvantages and provides a device which is distinguished in that around the pipe stub there is arranged a body capable of floating on the liquid, whilst airtight means are arranged between the floating body and either the pipe stub or the wall of the housing.

Thanks to the closing floating body it is now no longer necessary to have the pipe stub reaching into the liquid in the liquid chamber so that, when liquid is drained, a stream can directly flow beyond the liquid chamber towards the transport duct. During subatmospheric pressure in the transport duct the floating body will be lifted from the liquid level and open air can be sucked in. When the pressure is restored, the floating body will immediately return to the liquid level and establish the closure. In the event of excess pressure in the transport duct the floating body is pressed down on the liquid level and the closure remains safe. In the device proposed the total amount of liquid in the liquid chamber is considerably lower than in the known devices.

In one embodiment the airtight means are formed by a bellow-like membrane between the floating body and the housing wall. This ensures great freedom of movement of the floating body with respect to the housing or the pipe stub respectively.

In order to enhance the pass capacity of the device the invention proposes to provide a recess at least in the wall part of the pipe stub directed towards the drain stub. This recess may extend above the liquid level in the liquid chamber so that a direct communication can be established between the liquid level between the pipe stub and drain stub.

For flow-technical reasons the housing in one embodiment may have a threshold near the passage of the drain stub, which results in a venturi effect and hence an acceleration of the stream, which contributes to the pass capacity of the device. Preferably the pipe and/or the drain stub are each provided with fastening means arranged outside the housing for receiving and fastening the transport duct parts.

The above-mentioned and further features of the invention will be described more fully with reference to the accompanying figures of a few embodiments.

Figure 2:
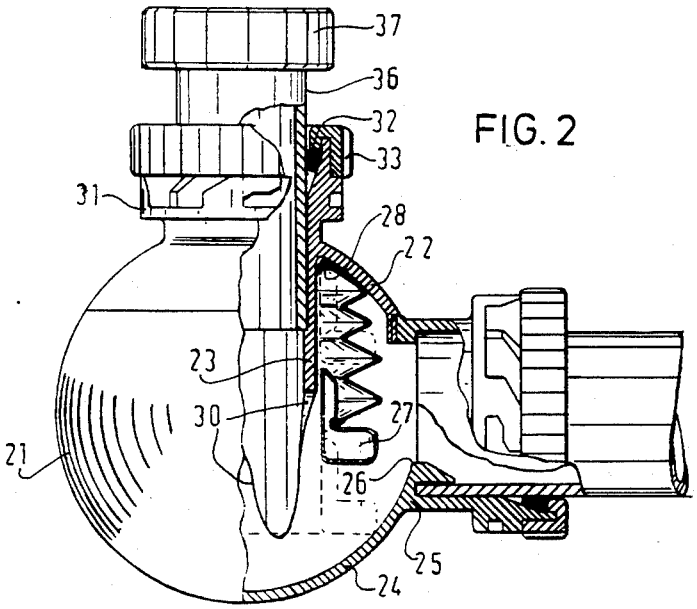
Figure 3:
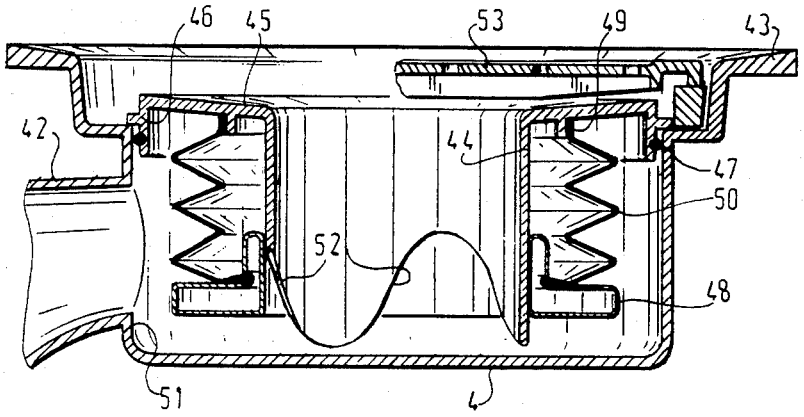

The drawing shows in:

FIG. 1 a vertical sectional view of a first embodiment of the closing device in accordance with the invention as a siphon, FIG. 2 a vertical sectional view of an alternative embodiment of a siphon, FIG. 3 a vertical sectional view of a third embodiment as a drainage pit.

The device shown in FIG. 1 mainly comprises a housing 1, for example, of synthetic material built up by two parts. The upper part 2 is substantially cylindrical with an end part conically tapering in upward direction. In the top wall 3 of said end part is arranged a pipe stub 4, which is preferably integral with the upper part 2 of the housing 1.

In the cylindrical jacket part of the upper part 2 opens out a drain stub 5, which is also integral with the upper part 2 of the housing 1.

The underside of the housing 1 is formed by a bottom part 6 fitting to the upper part 2.

At the transition from the inner space of the housing 1 to the drain stub 5 a narrowed part is formed by a threshold 7 on the underside.

Around the pipe stub 4 is arranged a floating body 8, which is substantially annular and may be made from any appropriate material. The floating body 8 has a sleeve part 9 adapted to slide around the lower end of the pipe stub 4. The sleeve part 9 and the floating body 8 may be made from the same material, but they may also be formed by two different parts, between which an airtight connection is ensured. The sleeve 9 is provided at the top end with a rim to which a bellow-like membrane 10 is fastened. On the other side the membrane 10 is fastened to the inner wall of the housing 1, that is to say, near the transition between the cylindrical part and the conical part thereof.

The outer circumference of the floating body 8 has a diameter exceeding the inner diameter of the bottom part 6.

Both the pipe stub 4 and the drain stub 5 have at the end protruding from the housing 1 a widening, collar-like part 11 adapted to receive an annular stuffing 12. It has screwthread on the outside for fastening a screw ring 13. Said means i.e. collar 11, stuffing 12 and screw ring 13 serve to fasten a pipe part 14, which may be fastened to the underside of a washing stand or a pipe part 15 forming the transport duct for draining the liquid.

The device shown in FIG. 1 operates as follows. When draining liquid through the duct 14 or the pipe stub 4 an amount of liquid will accumulate in the bottom part 6 of the housing up to the upper rim of the threshold 7. The floating body 8 will move upwards on the level of said amount of liquid into the position shown in FIG. 1. This movement is enabled by the flexibility of the bellow-like membrane 10. In this situation a complete closure is ensured between the open air and the transport duct 15. When draining an amount of liquid through the pipe stub 4, the liquid level in the housing 1 will rise taking along the floating body 8. Thus is liquid communication is established between the pipe stub 4 and the transport duct 15, the liquid flowing away across the threshold 7. In this condition the fully airtight closure is ensured between the duct 15 and the open air.

It should be noted that the drain capacity of the device may be enhanced by providing a recess 16 in the wall part of the pipe stub 4 directed towards the outlet duct 15. In this way a large amount of liquid can flow directly to the outlet duct 15 beyond the bottom part 6, that is to say, the liquid chamber.

In the event of subatmospheric pressure in the transport duct 15 ambient air will be sucked in through the pipe stub 4 along the lower rim thereof and between the floating body 8 and the liquid being sucked out of the chamber.

In the event of excess pressure in the transport duct 15 the floating in body 8 is pressed down so that part of the liquid will rise in the pipe stub. The downward movement of the floating body 8 is limited by the top rim of the bottom part 6. At a further increase is excess pressure in the transport duct 15 at the most the bellow-like membrane 10 will deform, but no gas of the duct 15 can escape.

It will be obvious that the liquid chamber need only contain a small amount of liquid in order to guarantee an absolute closure.

The device shown in FIG. 2 has a spherical housing part 21, the upper part 22 being again provided with a pipe-stub 23, which may be integral with the same. The lower part 24 of the housing 21 is provided with a drain stub 25, whilst a threshold 26 is formed at the transitional area. On the underside of the pipe stub 24 is arranged a floating body 27, which is also unitary with a sleeve adapted to be slipped around the lower end of the pipe stub 23. The sleeve is provided with a ring 28 closely fitting around the stub 23 to establish an airtight-closure.

In this case the wall part of the pipe stub 23 facing the drain stub 25 has three recesses 30, evenly distributed over the circumference.

Finally it is noted that the pipe stub 23 has, at the end protruding out of the housing 21, a collar 31 for receiving a stuffing ring in the form of an O-ring 32. An annular body 33 is coupled to the collar 31 by a so-called bayonet joint (not shown). This serves for a slidable connection of a duct part 36 provided with a screw ring 37 for fastening to the unserside of, for example, a washstand.

The drain stub 25 may have fastening means similar to those of the stub 23 for arranging therein a transport duct (not shown).

The operation of the device shown in FIG. 2 corresponds with that of the device of FIG. 1. It is noted that owing to the spherical shape of the lower part 24 of the housing 21 a stop for the floating body 27 may be dispensed with. The floating body 27 is limited in its downward movement by the inner wall of the lower part 24.

The embodiment shown has the advantage of a particularly small housing 21, which has nevertheless a high pass capacity and a satisfactory closing effect.

The embodiment shown in FIG. 3 is suitable for use as a floor pit, in which the housing 41 has a substantially cylindrical shape and is closed on the underside by a bottom part. In the sidewall of the cylindrical housing 41 is arranged a drain stub 42 which is integral with the housing. The top end of the housing 41 has an outwardly flaring flange part 43 which can be countersunk in a conventional manner in the cover of the floor in which the pit has to be arranged.

On the inner side of the cylindrical housing part 41 is provided a pipe stub 44 having a conically widening upper rim 45, which is provided along the circumference with a downwardly directed flange 46 which fits in an air-tight manner by means of the housing 41. On the underside of the pipe stub 44 a floating body 48 is slidable upwards and downwards. The floating body 48 is formed correspondingly with the one according to FIG. 2 and is connected at the upper rim with a bellow-like membrane 50. The other end of the bellow-like membrane 50 closely fits in airtight manner around a downwardly directed flange 49 of the pipe part 44.

On the wall part facing the drain stub 42 the pipe stub 44 has a recess 52.

The housing 41 is closed on the top side by a grating 53, which may have any appropriate shape.

It will be obvious that the operation of the floor pit embodying the invention corresponds with that of the embodiments shown in FIGS. 1 and 2.

The invention is not limited to the embodiments depicted above, for example, it is not necessary to provide a bellow-like membrane 10, 29 or 50 respectively, since a slidable seal, for example, an O-ring may be arranged between the sleeve 9, 28 and 49 respectively and the pipe stub 4, 23 and 44 respectively. This also provides the airtight seal between the floating body 48 and the associated pipe stub.

What is claimed is:

1. A device for closing by means of a liquid, a transport duct for said liquid, said device mainly comprising a housing with a liquid chamber, a pipe stub connected in an airtight manner with said housing and reaching at the most up to the liquid chamber and a drain stub opening out above the liquid chamber for connection with the transport duct, characterized in that around the pipe stub is arranged a body adapted to float on the liquid, and airtight means connected with the body for defining an isolated space around the pipe stub upwardly from said body and for allowing vertical floating movement of the body between a non-draining position and an upwardly buoyed draining position.

2. A device according to claim 1, characterized in that the air-tight means comprise a bellow-like membrane.

3. A device as defined in claim 2 wherein at least the wall part of the pipe stub directed toward the drain stub has a recess.

4. A device as defined in claim 2 wherein the housing has a threshold near the transition between the drain stub and the housing.

5. A device as defined in claim 2 wherein one of the pipe stub and the drain stub is provided adjacent the housing with fastening means for holding the transport duct parts.

6. A device according to claim 1, characterized in that at least the wall part of the pipe-stub directed towards the drain-stub has a recess.

7. A device as defined in claim 6 wherein the housing has a threshold near the transition between the drain stub and the housing.

8. A device as defined in claim 6 wherein one of the pipe stub and the drain stub is provided adjacent the housing with fastening means for holding the transport duct parts.

9. A device according to claim 1 characterized in that the housing has a threshold near the transition between the drain stub and the housing.

10. A device as defined in claim 9 wherein one of the pipe stub and the drain stub is provided adjacent the housing with fastening means for holding the transport duct parts.

11. A device as claimed in claim 1 characterized in that one of the pipe stub and the drain stub is provided at the end protruding out of the housing with fastening means for holding the transport duct parts.

12. A device as claimed in claim 11, characterized in that the free end of the stub widens in a collar-shaped manner to receive an annular stuffing, the outer side of the collar having fastening members for a closing ring fitting to the collar.

13. A drain device comprising the combination of:

a drain body having a circumscribing side wall, a bottom wall, an open top and a drain passage intersecting said side wall above the level of said bottom wall so as to define a liquid retention space therebelow;

vertically extending pipe means connected with said body for closing said open top thereof and defining a space within said body between the body and the pipe means and which space is in communication with said drain passage, said pipe means having a lower end portion presenting an outer guide surface portion and extending downwardly in said space to a level above said level of the bottom wall;

float means slidably guided on said guide surface portion of the pipe means for liquid-buoyed vertical movement thereon above and below the bottom level of said drain passage while effecting a circumferential seal with liquid buoying the float means which is in surrounding relation to said outer surface of the pipe means; and flexible membrane means connected with said float means for defining an isolated space around said pipe means upwardly from said float means and for allowing said vertical movement of said float means.

14. A drain device as defined in claim 13 wherein said float means presents a substantially flat, annular bottom surface to effect said circumferential seal.

15. A drain device comprising the combination of:

a drain body having a circumscribing side wall, a bottom wall and a drain passage intersecting said side wall above the level of said bottom wall so as to define a liquid retention space below such level;

pipe means for directing liquid into said retention space, said pipe means having a vertically extending lower end portion presenting an outer guide surface portion and a recess above said level communicating with said drain passage when it is exposed;

float means slidably guided on said outer guide surface portion for liquid-buoyed vertical movement thereon between an upwardly buoyed draining position above said level and exposing said recess when liquid is directed into the retention space to permit liquid to drain through said recess and said drain passage and a non-draining position buoyed by liquid trapped in said liquid retention space to effect a seal with such trapped liquid circumferentially around said pipe means at said level; and flexible membrane means connected with said float means and said device for allowing said vertical movement and for isolating said drain passage from said recess when the float means is in its non-draining position.

16. A drain device as defined in claim 15 wherein said pipe means is integral with said body.

17. A drain device as defined in claim 16 wherein said flexible membrane means is connected both to said float means and said pipe means.

18. A drain device as defined in claim 15 wherein said pipe means is separate from said body and is vertically movable relative thereto.

19. A drain device as defined in claim 18 wherein said pipe means rests upon said body and is provided with sealing means engaging circumferentially with the body, said flexible membrane means being connected both to said float means and said pipe means.

* * * * *